US005724892A

United States Patent [19]

Melzer

[11] Patent Number: 5,724,892

[45] Date of Patent: Mar. 10, 1998

[54] INNER COVERING FOR THE CONNECTING CORRIDORS BETWEEN RAIL VEHICLES

[75] Inventor: Norbert Melzer, Engen, Germany

[73] Assignee: Fiat-Sig Schienenfahrzeuge AG, Switzerland

[21] Appl. No.: 647,969

[22] PCT Filed: Oct. 3, 1995

[86] PCT No.: PCT/CH95/00222

§ 371 Date: Aug. 2, 1996

§ 102(e) Date: Aug. 2, 1996

[87] PCT Pub. No.: WO96/10510

PCT Pub. Date: Apr. 11, 1996

[30] Foreign Application Priority Data

Oct. 3, 1994 [CH] Switzerland ..... 2982/94

[51] Int. Cl.[6] ..... B60D 5/00

[52] U.S. Cl. ..... 105/17; 105/15; 105/8.1

[58] Field of Search ..... 105/8.1, 9, 15, 105/16, 17, 18, 23; 280/403

[56] References Cited

U.S. PATENT DOCUMENTS

| | | | |
|---|---|---|---|
| 4,252,065 | 2/1981 | Bickel et al. | 105/8.1 |
| 4,318,345 | 3/1982 | Kleim | 105/15 |
| 4,736,668 | 4/1988 | Ando et al. | 105/8.1 |
| 4,765,249 | 8/1988 | Ishizuka et al. | 105/17 |
| 4,781,123 | 11/1988 | Yoshihara et al. . | |
| 5,515,791 | 5/1996 | Britzke et al. | 105/8.1 |
| 5,546,866 | 8/1996 | Koch | 105/8.1 |

FOREIGN PATENT DOCUMENTS

| | | | |
|---|---|---|---|
| 206742 | 12/1986 | European Pat. Off. | 105/8.1 |
| 3541367 | 6/1986 | Germany | 105/8.1 |
| 3639898 | 6/1988 | Germany . | |
| 2139583 | 11/1984 | United Kingdom . | |

*Primary Examiner*—Mark T. Le

*Attorney, Agent, or Firm*—Ostrolenk,Faber,Gerb & Soffen,LLP

[57] ABSTRACT

The inner covering for the connecting corridors between cars of rail vehicles consists in each case of side wings, each of which consists of at least two independent frames (1, 2, 3) the spars of which are pivoted to each other at the corners, the frames being held in bottom and top telescopic guide rails (4). When the outermost vertical frame spars are fastened by hinges (8) to the car body or coupling frame, the inner covering can follow all movements which occur.

10 Claims, 3 Drawing Sheets

INNER COVERING FOR THE CONNECTING CORRIDORS BETWEEN RAIL VEHICLES

BACKGROUND OF THE INVENTION

The present invention relates to an inner covering for the connecting corridors between rail vehicles, i.e. corridors between the ends of two cars which are coupled to each other. Such corridors may be separable or not (in the case of compositions of trains which are not changed). The corridors have, in addition to the connection mechanism proper, an outer covering which is generally bellows-like and, for the covering said mechanical parts, frequently also an inner covering (for example also in bellows form, consisting of plastic).

It has recently been found that the known inner coverings are not fool proof against vandalism or, in the case of permanent embodiments, not fool proof against damage.

The purpose of the present invention was to create a stable inner covering for the connecting corridors of rail vehicles, i.e. stable side walls, which permit all actually occurring linear and rotatory movements without damage or dangerous openings.

This purpose is achieved with the new inner covering of the present invention.

SUMMARY OF THE INVENTION

In the solution of the invention, the movable frames which form side wings are connected to each other by the guide rails and covered by solid materials, i.e. extended, without substantial slot, up into the ceiling or bridge plates of the corridor.

Due to the construction of the side wings and, in particular, of the four articulated frames and the guide rails which extend into each other and connect the frames practically rigidly to each other:

- longitudinal and transverse movements which take place between the ends of the cars can be taken up by the guide rails, which are of variable length;
- vertical movements which take place between the ends of the cars are taken up by the guide rails and a parallelogram-like attachment of the frames;
- turning movements of the ends of the cars around the vertical axis, leading to lengthwise movements in opposite directions of the side wings are taken up via the guide rails;
- pitching movements between the ends of the cars are taken up by the guide rails and a parallelogram-like displacement of the frames; and
- swaying movements between the ends of the cars are taken up by the guide rails and the articulation points of the frames, or by a certain play in these articulation points, as well as a twisting of the coverings.

The coverings or cover plates are preferably trapezoidal in shape, with the long side of the trapezoid fastened on the outer vertical spars of the frames. Resultant openings in the covering are covered preferably by triangular filler members which are fastened to the upper and lower frame spars.

BRIEF DESCRIPTION OF THE DRAWING

The invention will be explained in somewhat greater detail below, with reference to embodiments shown in the drawing, in which:

FIGS. 1 and 2 illustrate diagrammatically the basic construction of a side wing of an inner covering for a connecting corridor between cars of rail vehicles. Articulated highway vehicles (articulated buses) would also correspond to such a rail vehicle.

The entire inner covering of the connecting corridor consists of four side wings, i.e. two per side, in the case of a separable connecting corridor arrangement with coupling frames, or of two side wings, i.e. one per side, in the case of a non-separable corridor arrangement.

One side wing consists of two or more independent holding frames which are connected to each other by upper and lower guide rails and possibly additional centering elements.

Figure 1:
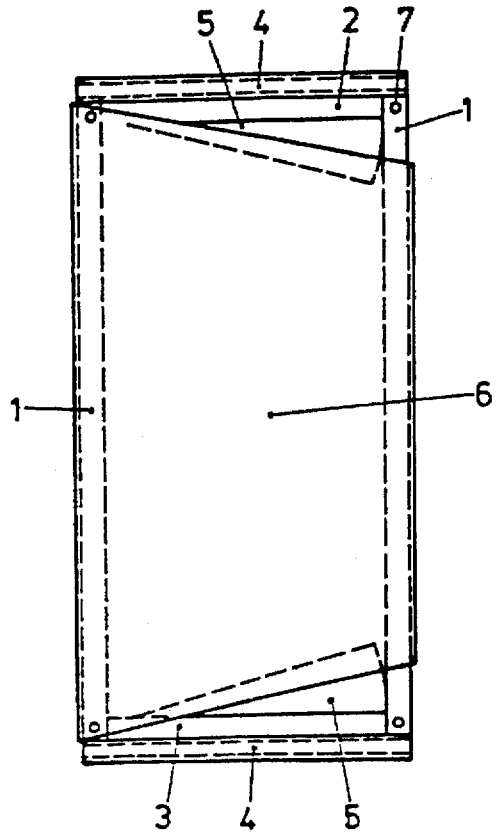
FIG. 1 shows, purely diagrammatically, the basic construction of a frame intended for the formation of a side wing.

FIG. 1 illustrates the construction of an individual element for a side wing, consisting of a holding frame of vertical spars 1 and horizontal spars 2, 3. The horizontal spars 2, 3 are guided in guide rails 4 and all the spars are connected to each other by pivots 7 at their corners. The pivots produce from the frame at least one four-bar arch or four-bar frame, which can change in a parallelogram-like manner.

Figure 2:
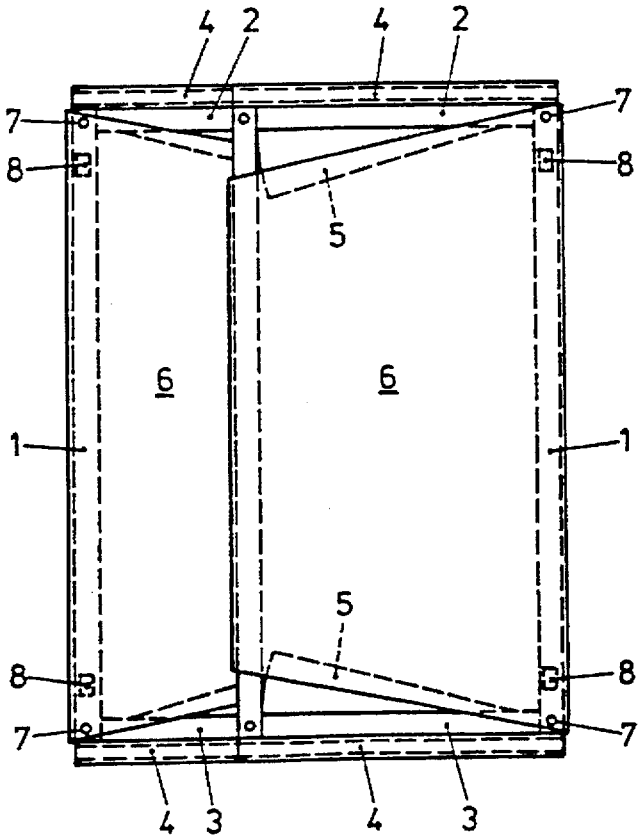
FIG. 2 shows a side wing, formed of two frames, of the inner covering of a connecting corridor.

As shown in FIG. 2, the side wing is arranged with its outermost vertical spars 1 swingable by hinges 8 on the car body and coupling frame or on one and the other car bodies, around the longitudinal axis of the vertical spar 1.

The guide rails 4 which are guided telescopically one within the other and which hold and guide the frames vertically, displaceable relative to each other, are pivoted, for instance, at their outermost ends also to the ends of the outermost spars 1.

On the outermost vertical spars 1 there are also fastened rigid cover plates 6, preferably of trapezoidal shape, so that no interferences can occur upon given movements of the individual frames. The openings between cover plates 6 and frames which are thereby produced are covered by so-called filler members 5, which are fastened in suitable manner in the horizontal frame spars 2, 3.

Due to the pivots 7 at the corners of the frame, the frame can be displaced in the manner of a parallelogram and at the same time, if necessary, twisted (due to some play in the joints).

Figure 3:
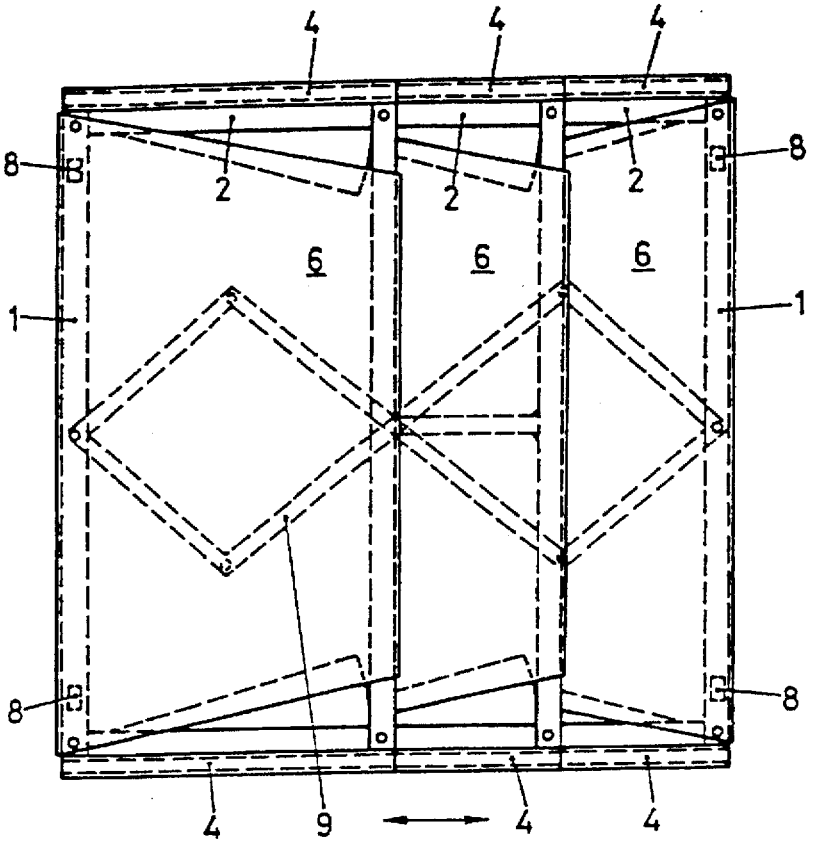
FIG. 3 shows a side wing, formed of three frames connected to each other by guide rails, the length of which wings can be reduced by the bringing together of the frames or increased by the pulling apart of the frames.

FIG. 3 shows a side wing formed of three frames. The guide rails 4 of the frames are guided in drawer-like or telescopic manner one within the other. In the case of three frames, an additional centering or guide device in the form of a scissors mechanism 9 is provided, as shown, it seeing to it that the central frame moves in predetermined manner with respect to the outer frames.

Figure 4:
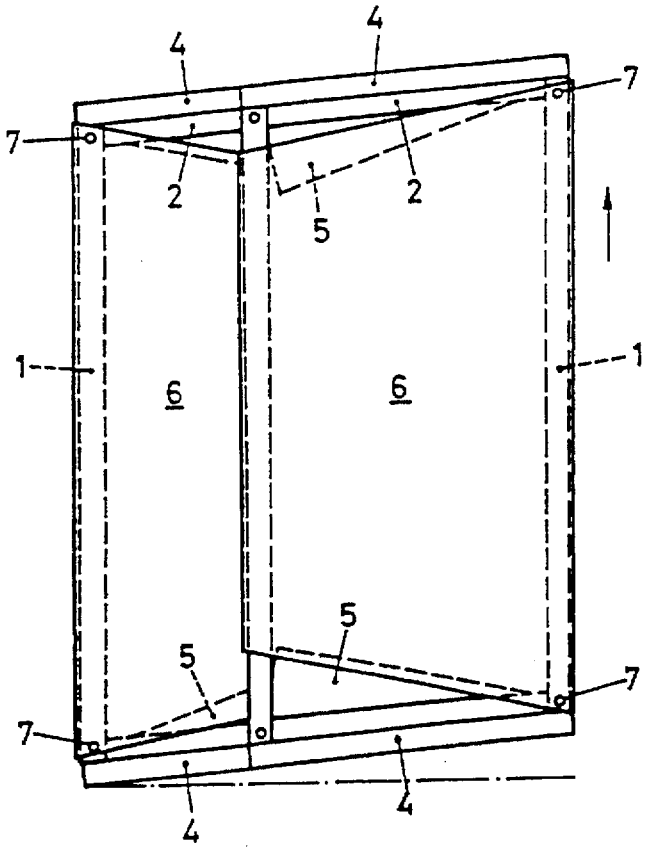
FIG. 4 shows the position of the frames, forming a side wing, with guide rails upon vertical movements between the ends of the cars.
Figure 5:
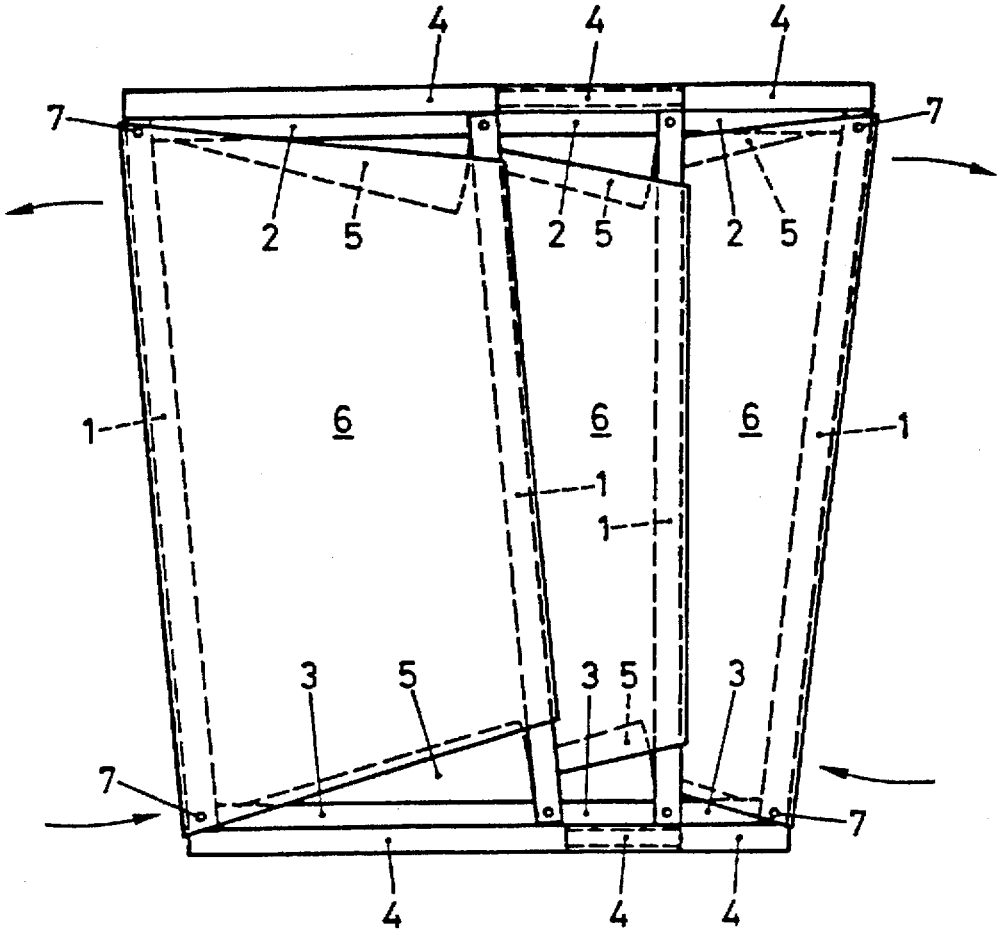
FIG. 5 shows the possible position of the frames forming a side wing upon pitching movements between the ends of the cars.

FIGS. 4 and 5 illustrate, in the case of side wings of two and three frame parts respectively, how the entire assembly can shift easily under certain external forces (movements in accordance with FIG. 4 can also be combined furthermore with those in accordance with FIG. 5).

Inner coverings of the type described above are simple to construct and manufacture. Their functioning is practically trouble-proof, and cover plates which have possibly been damaged can be replaced easily and rapidly.

I claim:

1. An inner covering for a connecting corridor between a first car body and a second car body of a vehicle, the inner covering comprising:

a first vertical spar pivotally attached to the first car body, the first vertical spar having an upper end and a lower end;

a second vertical spar pivotally attached to the second car body, the second vertical spar having an upper end and a lower end;

an upper guide rail having a telescopically variable length;

a lower guide rail having a telescopically variable length;

an upper horizontal spar disposed in the upper guide rail and pivotally attached to the upper ends of the first and second vertical spars;

a lower horizontal spar disposed in the lower guide rail and pivotally attached to the lower ends of the first and second vertical spars; and a cover plate coupled to the first vertical spar.

2. An inner covering according to claim 1, wherein the cover plate is of trapezoidal shape, the long side of the trapezoid being fastened to the first vertical spar.

3. An inner covering according to claim 2, further comprising:

substantially triangular first and second cover plates coupled respectively to the upper and lower spars in order to cover in complementary manner areas of the inner covering that are not covered by the trapezoidal cover plate.

4. An inner covering according to claim 1 wherein the outermost ends of the upper and lower guide rails are pivotally attached to the respective ends of the first and second vertical spars.

5. An inner covering according to any of claim 1, wherein the guide rails (4) are formed of U-shaped pieces which engage in drawer-like manner one within the other.

6. An inner covering according to claim 1, further comprising at least one middle spar having an upper end and a lower end, the upper and lower ends of the at least one middle spar being respectively pivotally coupled to the upper and lower horizontal spars.

7. An inner covering according to claim 6, further comprising centering elements coupled to the first, middle and second vertical spars.

8. An inner covering according to claim 7, wherein the centering element include scissors-form pulling members.

9. An inner covering according to claim 6, further comprising a second cover plate coupled to the second horizontal spar.

10. An inner covering according to claim 6, further comprising a second middle spar pivotally coupled to the upper and lower horizontal spars.

* * * * *